US006142462A

United States Patent [19]

Moser et al.

[11] Patent Number: 6,142,462

[45] Date of Patent: Nov. 7, 2000

[54] HORIZONTAL FEED TABLE AND METHOD

[75] Inventors: James R. Moser, Easton; Edward M. Otto, Bethlehem, both of Pa.

[73] Assignee: Bell & Howell Mail & Messaging Technologies Company

[21] Appl. No.: 08/982,800

[22] Filed: Aug. 15, 1997

[51] Int. Cl.[7] ..... B65H 1/26

[52] U.S. Cl. ..... 271/157; 271/3.08; 414/795.8

[58] Field of Search ..... 271/157, 275, 271/198, 196, 3.08; 414/795.8

[56] References Cited

U.S. PATENT DOCUMENTS

| | | | |
|---|---|---|---|
| 4,951,933 | 8/1990 | Mitzel et al. | 271/157 X |
| 5,022,641 | 6/1991 | Okada | 271/3.08 |
| 5,085,421 | 2/1992 | Sellers | 271/155 |
| 5,102,112 | 4/1992 | Takahashi | 271/9 |
| 5,130,724 | 7/1992 | Crowley | 346/1.1 |
| 5,150,891 | 9/1992 | Svyatsky et al. | 271/35 |
| 5,163,670 | 11/1992 | Sellers et al. | 271/157 |
| 5,167,408 | 12/1992 | Golicz . | |
| 5,284,335 | 2/1994 | Golicz | 271/149 |
| 5,342,036 | 8/1994 | Golicz | 271/3.1 |
| 5,435,536 | 7/1995 | Adachi et al. | 271/157 |
| 5,494,272 | 2/1996 | Golicz | 271/3.03 |

*Primary Examiner*—Christopher P. Ellis
*Assistant Examiner*—Patrick Mackey
*Attorney, Agent, or Firm*—Jenkins & Wilson, P.A.

[57] ABSTRACT

In a method of continuously feeding sheets, a top-sheet pick-up device and a feed table for feeding stacks of sheets to the pick-up device are provided. A stack of sheets are placed on the feed table and fed towards the pick-up device. When it is detected that the uppermost sheets are positioned under the pick-up device, the pick-up device separates the uppermost sheet from the stack. The feed table continues to feed the stack toward the pick-up device by moving additional sheets into position under the pick-up device when no sheet is detected under the pick-up device. Also provided are a feed table including an angle bracket for registering and shingling sheets, and a method of converting a non-continuous high-capacity top-sheet feeder having a top-sheet pick-up device into a continuous high-capacity top-sheet feeder.

26 Claims, 6 Drawing Sheets

HORIZONTAL FEED TABLE AND METHOD

BACKGROUND OF THE INVENTION

This invention is directed to the art of media handling, in general, and methods and apparatus for converting non-continuous media handling devices into continuous media handling devices, in specific. Typically, the media comprises sheet material in the form of paper sheets.

A common method of sheet handling comprises the use of a high capacity top-sheet pick-up device, commonly known as a high capacity top-sheet feeder (hereinafter "HCTSF") to feed sheets from a vertically disposed stack of sheets found on a incrementally vertically movable table, to a down stream location. In particular, the uppermost sheet of the stack is picked off (i.e., separated), using a top-sheet pick-up device, for example, a vacuum pick-up located in the HCTSF, and the table then constantly and incrementally raised to maintain the uppermost sheet close to the top-sheet pick-up device for separation and removal of the top-sheet from the stack.

We have found problems with this arrangement. For example, when the stack of sheets on the table has been completely fed, the HCTSF (and any downstream machinery) must be stopped, the table lowered, a new stack of sheets placed on the table, and the HCTSF (and any downstream machinery) re-started. Thus, during this stack replenishment period, no sheets are being fed to the downstream machinery, rendering the HCTSF both non-continuous, and inefficient, in operation.

Furthermore, in this arrangement, the stack of sheets on the movable table is often in the range of 12–18 inches high. Stacks this high become unpredictable and hard to manipulate. For example, typically, the toner (or ink) distribution on sheets is uneven because the sheets will not have printed matter entirely thereon, i.e., the sheet will not be totally black. Thus, each individual sheet will be thicker in the area on which it has printed matter. As more and more sheets are stacked upon each other, these thicker portions multiply in effect to the point where the top surface of the sheet stack becomes uneven (non-planar). This makes it hard for a rigidly mounted top-sheet pick-up device to properly separate the top-sheet. Accordingly, a method by which this problem could be solved was searched for. While the prior art solution involved the manipulation of carefully positioned weights on the top of the sheet stack, this was a difficult solution to implement and a better solution was needed.

Accordingly, there is room for improvement within the art.

OBJECTS OF THE INVENTION

It is an object of the invention to provide a horizontal feed table and method for its use that allows for continuous feeding of sheets to a downstream operation.

It is a further object of the invention to provide a horizontal feed table and method for its use that minimizes the toner addition effects caused by large stack heights.

It is further object of the invention to provide a horizontal feed table and method for its use that minimizes the toner addition effects caused by large stack heights without requiring the difficult manipulation of weights on the top of the sheet stack.

It is a further object of the invention to provide a method by which a device that is intended to feed sheets in a non-continuous manner to a downstream location can be converted into a device that feeds sheets in a continuous manner to the downstream location.

These and other objects of the invention are achieved by a horizontal feed table, comprising: vertically disposed legs; a horizontal conveyor table supported by the legs and having front and rear ends; a conveyor spanning the length of the conveyor table; a conveyor drive for driving the conveyor; an angle bracket attached to, and extending upwardly out from, the front end of the conveyor table, the angle bracket having slots therein; stop members positioned immediately in front of the angle bracket on a side thereof opposite from the conveyor table; and sensors positioned next to the stops, the sensors in communication with the conveyor drive.

These and other objects of the invention are further achieved by a method of feeding sheets, comprising the steps of: providing a top-sheet pick-up device; providing a horizontal feed table for feeding stacks of sheets to the to-sheet pick-up device; placing a first reverse-shingled stack of sheets onto the feed table; feeding the first reverse-shingled stack of sheets in a direction towards the top-sheet pick-up device; detecting when the uppermost sheets of the reverse-shingled stack of sheets are positioned under the top-sheet pick-up device; separating the upper-most sheet from the reverse-shingled stack of sheets using the top-sheet pick-up device; and using the horizontal feed table to move additional sheets into position under the top-sheet pick-up device when no sheet is detected under the top-sheet pick-up device.

DETAILED DESCRIPTION OF THE INVENTION

With reference to the drawings, a horizontal feed table and method of its use that meets and achieves the various objects of the invention set forth above will now be described.

Figure 1A:
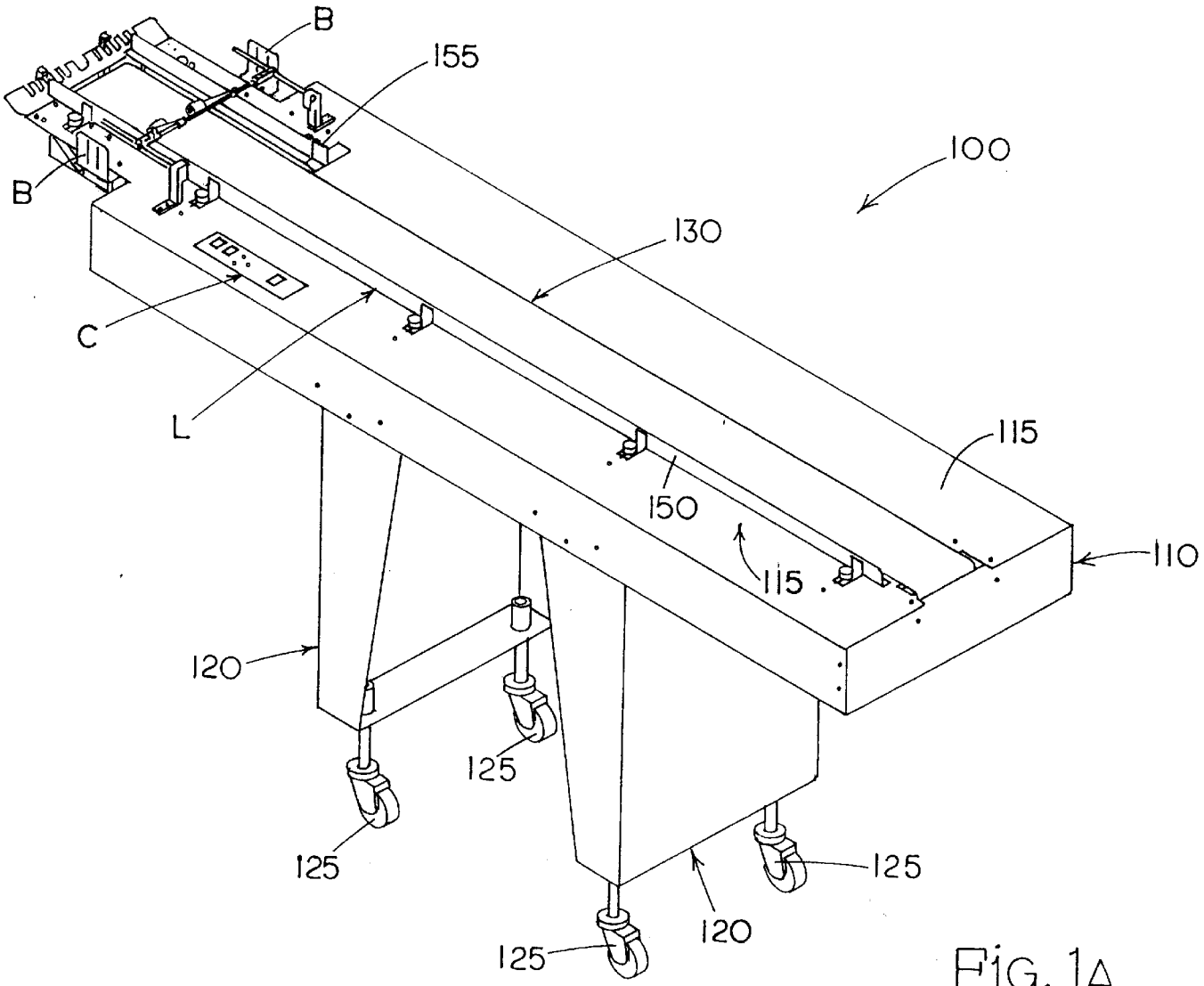
FIG. 1A is a perspective view of an exemplary embodiment of a horizontal feed table capable of achieving the goals according to the invention.
Figure 1B:
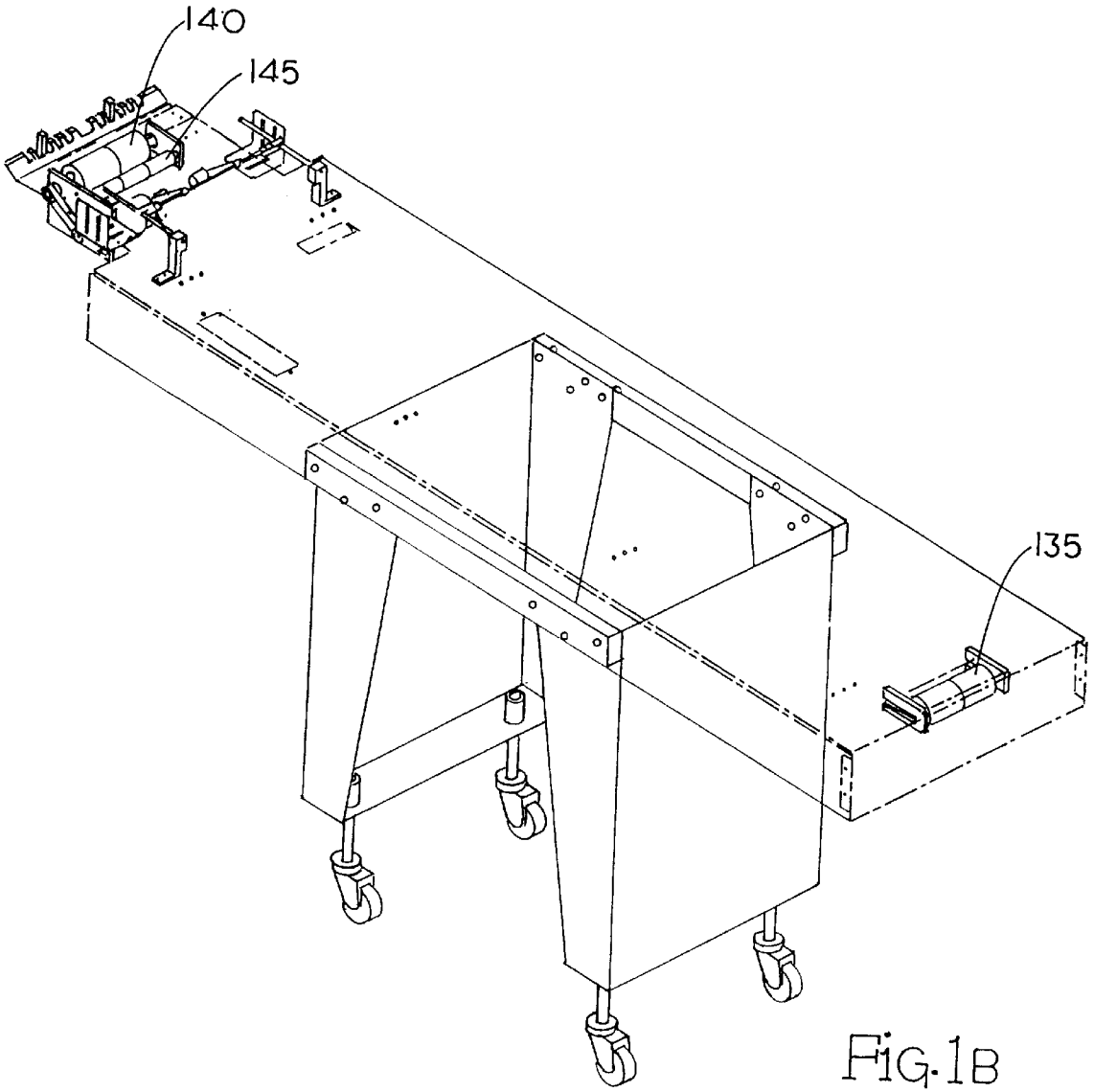
FIG. 1B is a perspective view of an exemplary embodiment of a horizontal feed table capable of achieving the goals according to the invention and with the conveyor belt omitted to show the details of the conveyor.

An exemplary embodiment of a horizontal feed table 100 according to the invention is shown in FIG. 1A. Horizontal feed table 100 comprises horizontal table 110 supported by legs 120 mounted to casters 125. Casters 125 allow horizontal feed table 100 to be rolled into position inside a HCTSF, as will be described below with reference to FIGS. 2A, 2B. Conveyor belt 130 spans the length of horizontal table 110 and is wrapped around end pulleys 135, 140 (FIG. 1B). Take-up pulley 145 (FIGS. 1B, 3) increases the amount by which conveyor belt 130 wraps around pulley 135, as is known in the art.

Mounted to top surface 115 of horizontal table 110 are adjustable first side guides 150 and adjustable second side guides 155, whose functions will both be described below.

The lateral positions of adjustable side guides 150, 155, are adjustable with respect to the central axis of conveyor belt 130 to account for sheets of different widths. Also mounted to top surface 115 of horizontal table 110 is electronic control panel C for operating and controlling horizontal feed table 100. The functions available by control panel C can vary according to need and are conventionally implementable.

Figure 2B:
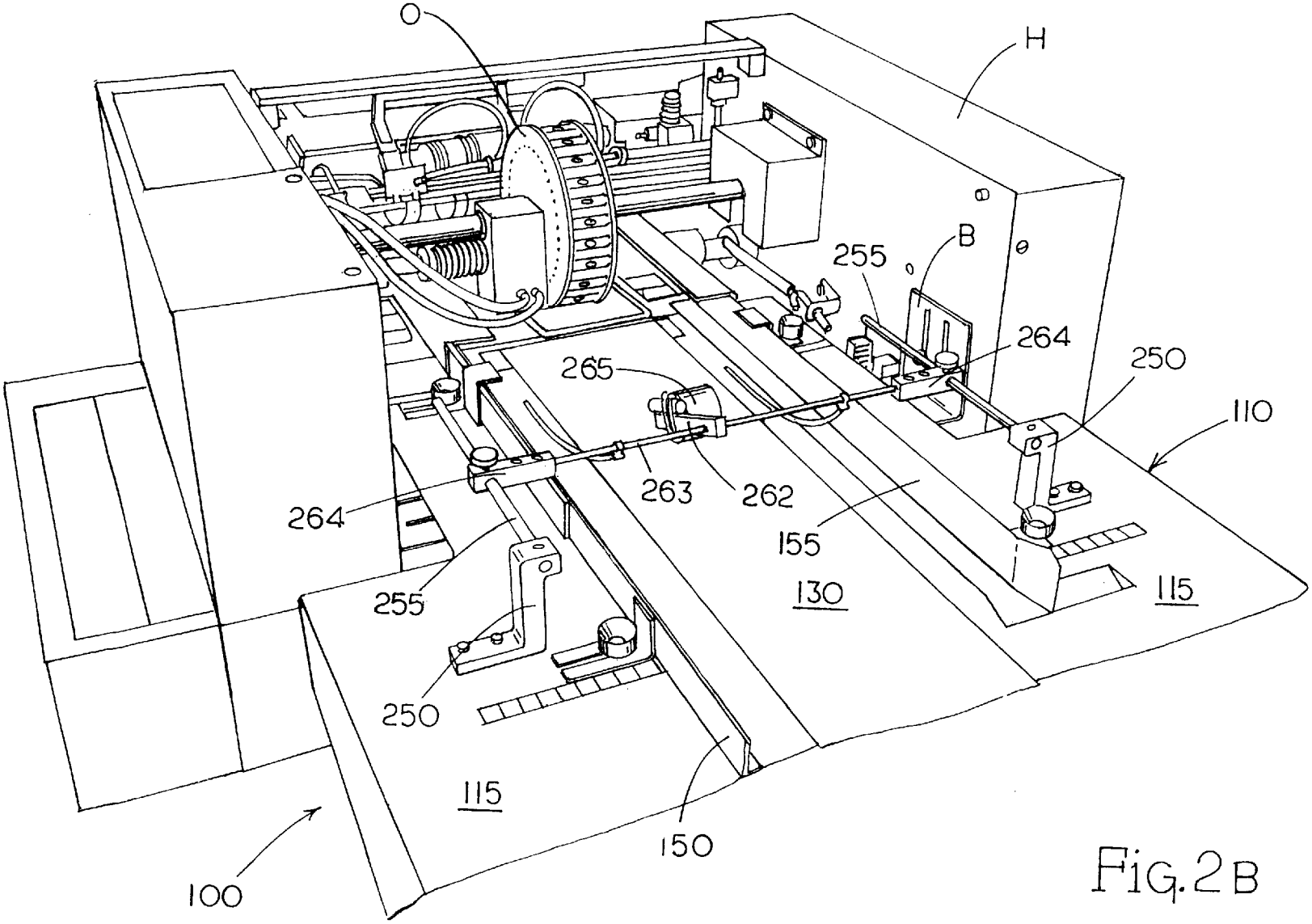
Figure 3:
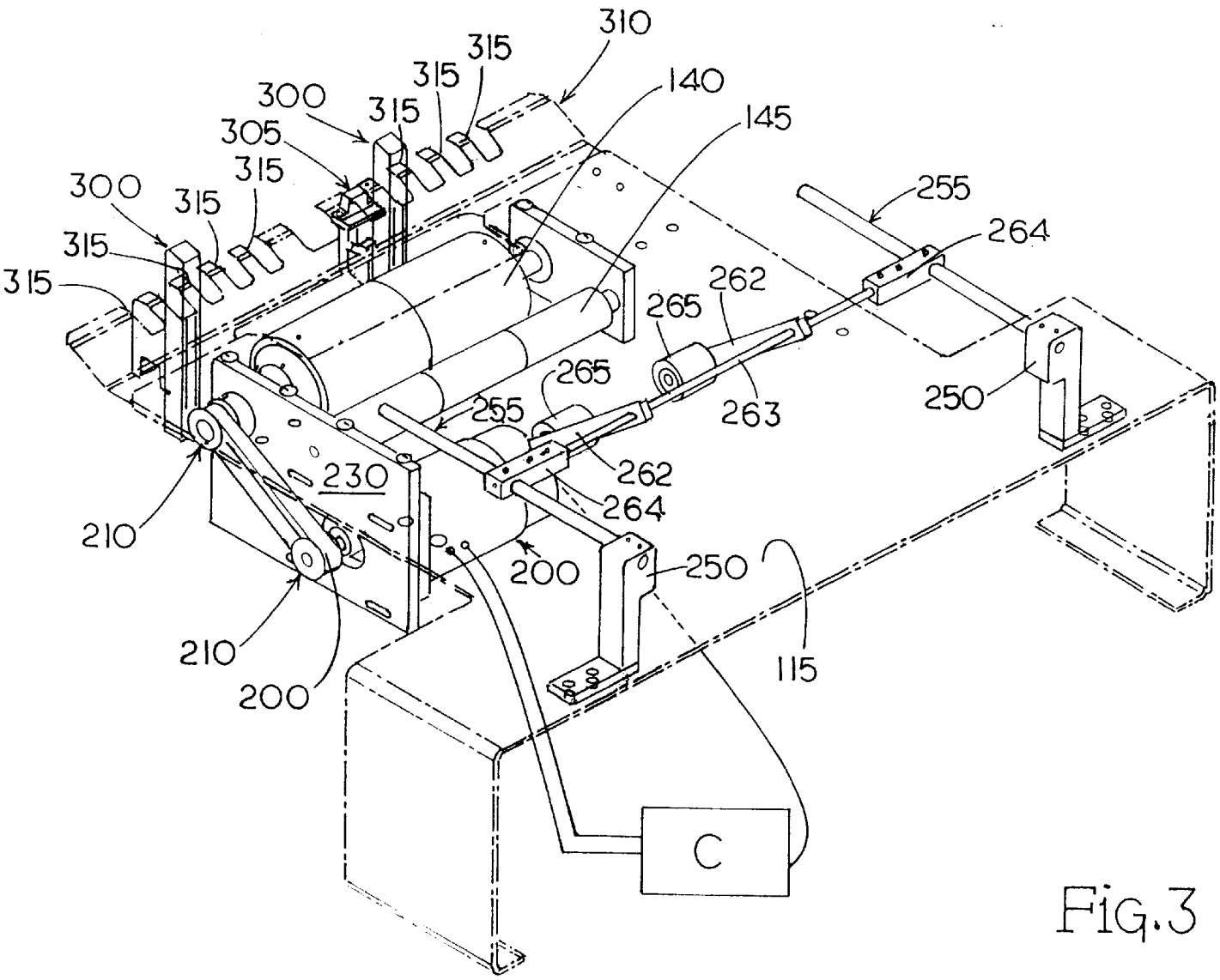
FIG. 3 is a detailed perspective view of the end of the exemplary horizontal feed table shown in FIGS. 1A, 1B that is positioned under the pick-up of the HCTSF.

The front end of horizontal feed table 100 is shown in detail in FIG. 3. By front end, Applicants mean the end of horizontal feed table 100 that will be mated with, or inserted into the HCTSF and attached thereto by use of mounting brackets B (FIG. 1A). This front end of horizontal feed table 100 is narrower than the rest of horizontal feed table 100 so that the front end of the horizontal feed table 100 can be inserted in the narrow opening of the HCTSF (FIG. 2B).

DC motor 200 is mounted under horizontal table 110 and drives pulley 140 through pulleys 210 and drive belt 220. Motor 200 and pulleys 210 and belt 220 are mounted on opposite sides of a vertical support plate 230.

Also mounted to top surface 115 of horizontal table 110 are vertical pillars 250. Vertical pillars 250 support beams 255 that are typically parallel to conveyor belt 130 and used to support overhead rollers 265 over top surface 115. Overhead rollers 265 are supported by beams 255 by use of arms 262, longitudinal member 263, and friction bearings 264. Friction bearings 264 allow the distance between overhead rollers 265 and the front end of horizontal feed table 100 to be varied dependent upon the length of the sheet being fed. Overhead rollers 265 provide a downward (normal) force equal to the weight of overhead rollers 265, i.e., overhead rollers 265 are not spring loaded, on the sheets being fed to prevent double feed into the HCTSF. While the use of overhead rollers 265 is preferred because they provide for less potential for toner or ink smudging, etc., other means are acceptable.

Figure 4A:
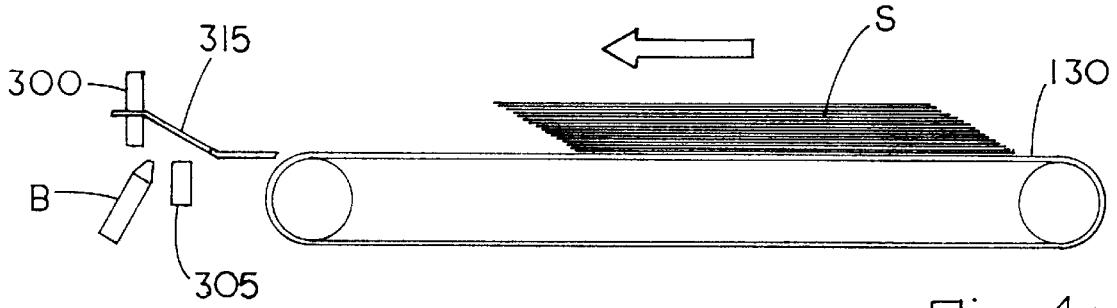
FIGS. 4A, 4B, 4C show how the horizontal feed table according to the invention registers sheet stacks.
Figure 4B:
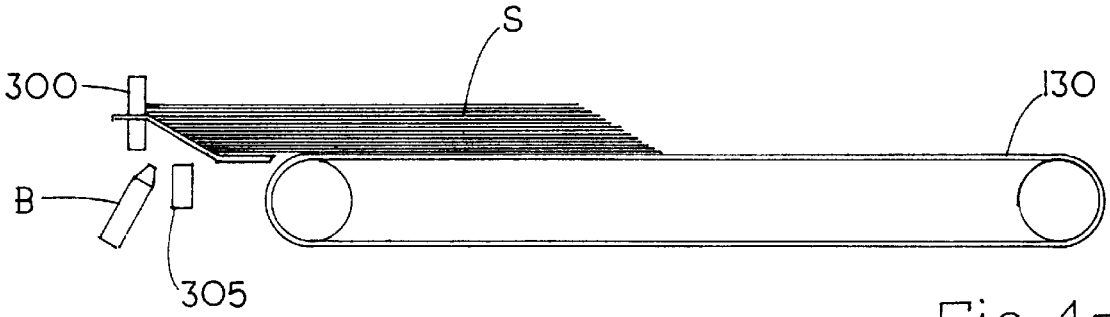
Figure 4C:
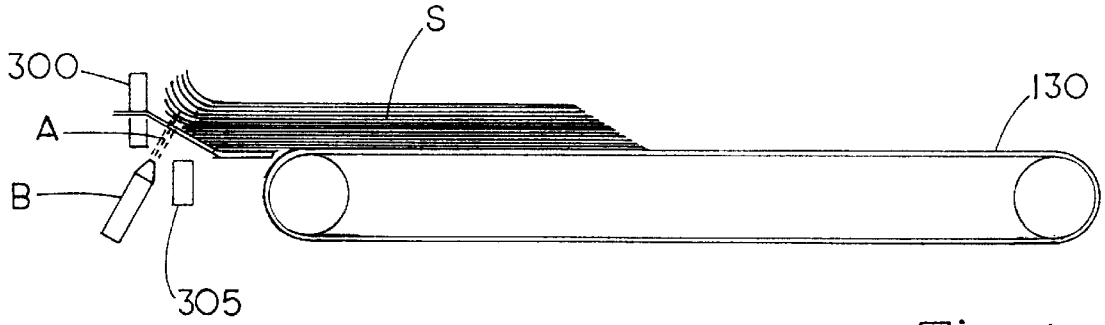

At the very front of horizontal feed table 100 are stops 300, sensors 305, and angle bracket 310 having slots 315 therein. Sensor 305 is electronically connected to motor 200 and control panel C by conventional circuitry so that when sensor 305 does not detect a sheet, motor 200 is on, and when sensor 305 detects a sheet, motor 200 is off. Typically, sensor 305 will be an optical sensor that detects a sheet when covered and detects no sheet when uncovered. As shown in FIGS. 4A, 4B, angle bracket 310 registers and shingles a sheet stack S as it is moved in the direction of the arrow and into contact with angle bracket 310. Stops 310 prevent sheets from stack S from traveling too far into the HCTSF and causing a jam. Slots 315 allow air A from conventional blowers B that are part of HCTSF H to be blown towards the registered and shingled stack of sheets (FIG. 4C).

Having described the structure of horizontal feed table 100, its method of operation will now be described. When a facility determines that the use of the HCTSF in its normal non-continuous configuration is too slow and inefficient, it is anticipated that they will seek to convert the HCTSF to a continuous operating device by merely acquiring horizontal feed table 100 according to the invention. Accordingly, the invention is intended to be a retro-fit and does not require the purchase of a different HCTSF.

Figure 2A:
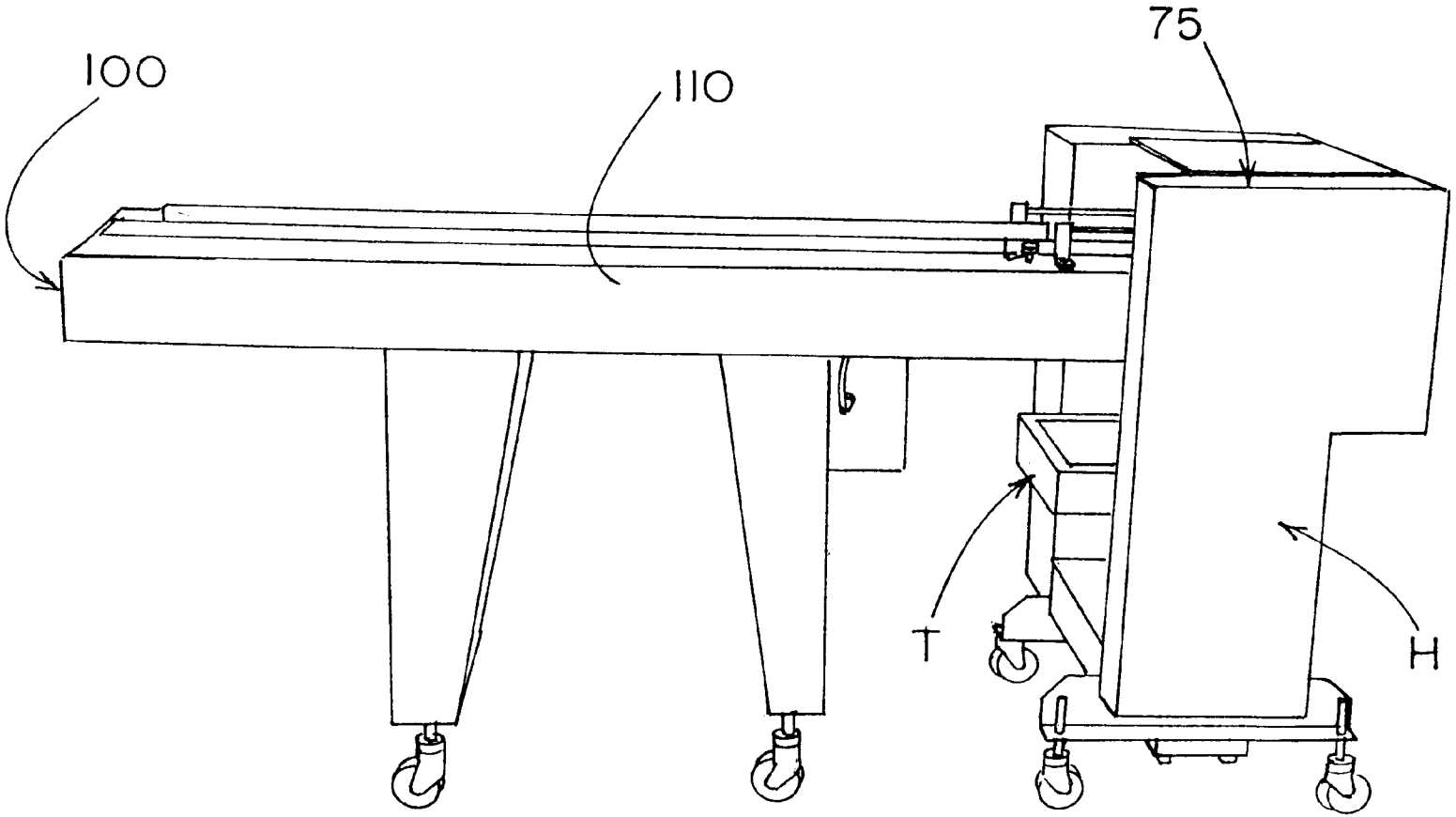
FIGS. 2A, 2B are perspective views of the exemplary horizontal feed table of FIGS. 1A, 1B when mated with a HCTSF.

Prior to the conversion, as shown in FIGS. 2A–B, feed table T of HCTSF H is lowered to a position under which horizontal table 110 will span. Then the motor (not shown) that normally raises table T will be disengaged in any number of conventional ways, such as by disconnecting the electrical power leading to the motor. This can be done because table T is no longer needed due to the fact that sheet material will be fed to HCTSF H by horizontal feed table 100.

Horizontal feed table 100 is rolled, using casters 125, into the opening of HCTSF H. Using brackets B, the HCTSF and the horizontal feed table 100 are rigidly connected together and then electrical power and a control line is fed to the horizontal feed table 100 from the HCTSF so that the two units can communicate with one another. Making these electrical and mechanical connections only requires ordinary skill in the art. Horizontal feed table 100 is now ready for use.

An operator, either human or automated, then places a stack of sheets onto conveyor belt 130. This stack of sheets is squared (width-wise) against first side guide 150, which will have been previously adjusted to its proper position based upon the width of the sheets in the stack. The stack of sheets will normally be about ¾ high. While it would be preferred to reverse-shingle the stack of sheets (top of stack leads bottom of stack) by approximately 1/32, this is not critical due to the shingling adjusting effect achieved by angle bracket 310 (see description above and FIGS. 4A–C).

At start-up, sensor 305 will not detect a sheet and therefor motor 200 will be turned on and the sheet stack fed by conveyor belt 130 towards the front of horizontal feed table 100, between side guides 150, 155, and under overhead rollers 265, both of which are now positioned inside of the HCTSF. The sheet stack will hit angle bracket 310 and be registered thereby. When sensor 305 detects a portion of the sheet stack, motor 200 will be shut off. Typically, it is foreseen that sensor 305 will detect the uppermost portion of the sheet stack. The sheets will now be ready for feeding via the HCTSF.

Blowers B incorporated into the HCTSF will be turned on via a control signal and air emitted therefrom will fan the uppermost few sheets of the sheet stack to reduce the friction there between (FIG. 4C). The stack remains registered because it is held between side guides 150, 155. The uppermost sheet of the stack will then be fed into the HCTSF by the HCTSF's top-sheet pick-up device, e.g., an overhead conveyor, typically in the form of an overhead vacuum conveyor O (FIG. 2B). As a portion of the uppermost sheet is pulled into the HCTSF, overhead rollers 265 will apply a normal force equal to their weight to the next uppermost sheet. This normal force will exceed the friction force between the sheet being fed by the overhead conveyor and this next uppermost sheet. Thus, overhead rollers 265 in combination with the sheet fanning caused by blowers B substantially prevent double feed.

After a few of the uppermost sheets are fed into the HCTSF, sensor 305 no longer detects a sheet. This activates motor 200 and brings more sheets into position for feeding into the HCTSF as described above.

After a portion of the stack has been fed into the HCTSF, it becomes time to replenish the stack. With the instant invention, this can be achieved without stopping the HCTSF or any downstream machinery. To achieve this goal, the operator, either human or automated, lifts the rear end of the original stack being fed from and inserts another stack under it and towards the front end of horizontal feed table 100. This is not difficult to do since the low stack height results in a fairly light stack. Thus, as conveyor 130 continues to move the original stack towards angle bracket 310, it simultaneously brings the new stack into position and allows for sheets to be fed therefrom after the original stack is depleted. By repeatedly following these steps, sheet replenishment becomes a continuous cycle and neither the HCTSF nor any downstream machinery need never be shut off. This saves the machine operator about 20 minutes per one hour of machine operation time. This time period is slow enough for a human or automated operator to handle, yet fast enough to assure that HCTSF is never completely emptied to the point that it or downstream machinery must be shut down.

The above description is directed to horizontal feed table and method for its use. However, it will be understood that various details of the invention may be changed without departing from the scope of the invention. Furthermore, the foregoing description is for purpose of illustration only, and not for purpose of limitation, as the invention is defined by the following, appended claims.

That which is claimed:

1. A method of continuously feeding sheets, comprising the steps of:

(a) providing a top-sheet pick-up device;

(b) providing a horizontal feed table for feeding stacks of sheets to said top-sheet pick-up device;

(c) placing a first stack of sheets onto said feed table;

(d) feeding said first stack of sheets in a direction towards said top-sheet pickup device;

(e) detecting when an original uppermost portion of said first stack of sheets is in a pick-up position under said top-sheet pick-up device;

(f) separating sheets of said original uppermost portion which are in said pick-up position from said first stack of sheets using said top-sheet pick-up device to leave a remainder of said first stack of sheets on said feed table upstream from said pick-up position; and (g) after sheets of said original uppermost portion have been separated and are no longer detected under said top-sheet pick-up device, continuing to feed said remainder of said first stack of sheets in the direction towards said pick-up position by advancing an uppermost portion of said remainder of said first stack of sheets along said horizontal feed table to said pick-up position.

2. The method according to claim 1, wherein said step of continuing to feed said first stack of sheets in the direction towards said top-sheet pickup device occurs after a sheet is removed from said stack by said top-sheet pick-up device.

3. The method according to claim 2 comprising the step of:

(h) advancing a second stack of sheets under said remainder of said first stack of sheets.

4. The method according to claim 3, wherein said step of placing another stack of sheets under said first stack of sheets is done manually.

5. The method according to claim 3, wherein said step of placing a second stack of sheets under said first stack of sheets is done automatically.

6. The method according to claim 1, further comprising the step of applying a downward normal force to the next-to-uppermost sheet to prevent double feed.

7. The method according to claim 6, wherein said step of applying a downward normal force is done by an overhead device.

8. The method according to claim 7, further comprising the step of using blowers to fan the uppermost sheets of said stack to further prevent double feed.

9. The method according to claim 1, further comprising the step of registering the front of said sheet stack.

10. A method of converting a non-continuous high-capacity top-sheet feeder having a top-sheet pick-up device into a continuous high-capacity top-sheet feeder, comprising the steps of:

(a) providing a high-capacity top-sheet feeder in which sheets are normally stacked on a vertically movable horizontal table and wherein said stacked sheets are brought into contact with a top-sheet pick-up device by incrementally raising said table;

(b) lowering said table of said high-capacity top-sheet feeder;

(c) making said table unable to rise;

(d) placing a horizontal conveyor above said table and at least under said top-sheet pick-up device;

(e) providing a first stack of sheet material onto said conveyor;

(f) conveying said first stack of sheets in a direction towards said top-sheet pick-up device;

(g) detecting when the uppermost sheets of said first stack of sheets are positioned under said top-sheet pick-up device;

(h) separating up said upper-most sheet from said first stack of sheets using said top-sheet pick-up device; and (i) continuously using said horizontal conveyor to move additional sheets into position under said sheet top-sheet pick-up device when no sheet is detected under said top-sheet pick-up device.

11. The method according to claim 10, wherein said step of using said horizontal conveyor to move additional sheets into position under said top-sheet pick-up device when no sheet is detected under said top-sheet pick-up device occurs after a sheet is removed from said first stack of sheets by said top-sheet pick-up device.

12. The method according to claim 11, wherein as said first stack of sheets is nearly depleted, a second stack of sheets is placed under said first stack of sheets.

13. The method according to claim 12, wherein said step of placing said second stack of sheets under said first stack of sheets is done manually.

14. The method according to claim 12, wherein said step of placing said second stack of sheets under said first stack of sheets is done automatically.

15. The method according to claim 10, further comprising the step of applying a downward normal force to the next-to-uppermost sheet to prevent double feed.

16. The method according to claim 15, wherein said step of applying a downward normal force is done by an overhead device.

17. The method according to claim 10, further comprising the step of registering the front end of said stack of sheets.

18. A horizontal feed table, comprising:

(a) vertically disposed legs;

(b) a horizontal conveyor table supported by said legs and having front and rear ends;

(c) a conveyor spanning the length of said conveyor table;

(d) a conveyor drive for driving said conveyor;

(e) means disposed at said front end of said conveyor table for registering and shingling a stack of sheet material disposed on said conveyor table;

(f) stop members positioned immediately in front of said registering and shingling means on a side thereof opposite from said conveyor table; and (g) sensors positioned next to said stops, said sensors in communication with said conveyor drive.

19. The method according to claim 1 wherein the step of detecting when said original uppermost portion of said first stack of sheets is in said pick-up position includes providing a sensing device adapted to detect the presence or absence of sheets of said original uppermost portion in said pick-up position.

20. The method according to claim 1 wherein said step of feeding said first stack of sheets in a direction towards said top-sheet pick-up device includes registering and shingling said first stack of sheets against an angle bracket disposed at a front end of said feed table proximate to said top-sheet pick-up device.

21. The method according to claim 1 further comprising the step of providing a stop member at a front end of said feed table to limit an amount by which said first stack of sheets travels on said feed table and to prevent jamming of said first stack of sheets.

22. The method according to claim 10 further comprising the step of using blowers to fan the uppermost sheets of said first stack to prevent double feed.

23. The method according to claim 10 wherein said first stack of sheets is reverse-shingled prior to being provided onto said conveyor.

24. The method according to claim 10 wherein said step of conveying said first stack of sheets in a direction towards said top-sheet pick-up device includes registering and shingling said first stack of sheets against an angle bracket disposed at a front end of said conveyor proximate to said top-sheet pick-up device.

25. The method according to claim 10 further comprising the step of providing a stop member at a front end of said conveyor to limit an amount by which said first stack of sheets travels on said conveyor and to prevent jamming of said first stack of sheets.

26. The feed table according to claim 18, wherein said registering and shingling means includes an angle bracket attached to and extending upwardly out from said front end of said conveyor table, and wherein said stop members are positioned immediately in front of said angle bracket.

* * * * *